US008714944B2

(12) United States Patent
Drevet

(10) Patent No.: US 8,714,944 B2
(45) Date of Patent: May 6, 2014

(54) DIAPHRAGM PUMP WITH A CRINKLE DIAPHRAGM OF IMPROVED EFFICIENCY

(75) Inventor: Jean-Baptiste Drevet, Paris (FR)

(73) Assignee: AMS R&D SAS, Venette (FR)

( * ) Notice: Subject to any disclaimer, the term of this patent is extended or adjusted under 35 U.S.C. 154(b) by 476 days.

(21) Appl. No.: 13/056,585

(22) PCT Filed: Jul. 23, 2009

(86) PCT No.: PCT/FR2009/000915

§ 371 (c)(1),
(2), (4) Date: Jan. 28, 2011

(87) PCT Pub. No.: WO2010/012887

PCT Pub. Date: Feb. 4, 2010

(65) Prior Publication Data

US 2011/0176946 A1 Jul. 21, 2011

(30) Foreign Application Priority Data

Aug. 1, 2008 (FR) ..... 08 04390

(51) Int. Cl.
*F04B 45/047* (2006.01)

(52) U.S. Cl.
USPC ..... 417/413.1

(58) Field of Classification Search
USPC ..... 417/395, 413.1, 470, 471
See application file for complete search history.

(56) References Cited

U.S. PATENT DOCUMENTS

| | | | | |
|---|---|---|---|---|
| 3,187,990 | A | 6/1965 | Chausson | |
| 6,264,438 | B1 * | 7/2001 | Fukami | 417/412 |
| 2004/0086398 | A1 | 5/2004 | Lehrke et al. | |

FOREIGN PATENT DOCUMENTS

| | | |
|---|---|---|
| FR | 2 861 910 | 5/2005 |
| GB | 662047 | 11/1951 |
| WO | WO-97/29282 | 8/1997 |

* cited by examiner

*Primary Examiner* — Charles Freay
*Assistant Examiner* — Philip Stimpert
(74) *Attorney, Agent, or Firm* — Muncy, Geissler, Olds & Lowe, P.C.

(57) ABSTRACT

A pump having an undulating diaphragm mounted for undulating between two end plates under drive from at least one electromagnetic actuator in order to transfer a fluid between an inlet of the pump and an outlet of the pump. The pump includes adapter means connecting the diaphragm support to a movable portion of the actuator in order to shorten the stroke of the movable mass of the actuator such that its stroke is shorter than the stroke of the diaphragm support.

5 Claims, 3 Drawing Sheets

FIG 2 Bis
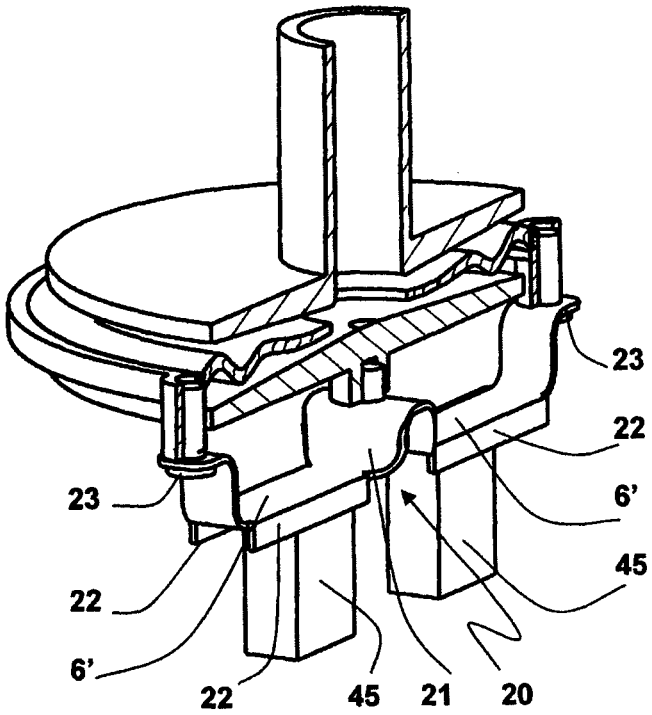
FIG 3
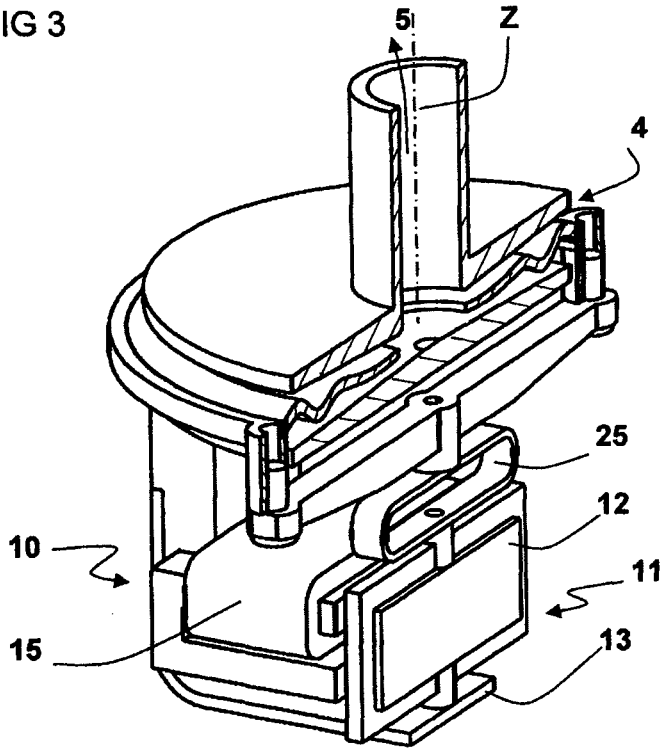

DIAPHRAGM PUMP WITH A CRINKLE DIAPHRAGM OF IMPROVED EFFICIENCY

The present invention relates to an undulating diaphragm pump of improved efficiency.

BACKGROUND OF THE INVENTION

Undulating diaphragm pumps are known, e.g. from document FR 2 744 769, in which the diaphragm is mounted to undulate between two end plates under drive from at least one linear electromagnetic actuator in order to transfer a fluid from an inlet of the pump to an outlet of the pump between the diaphragm and the end plates.

The diaphragm is fastened to a rigid diaphragm support. The movable portion of the actuator is generally coupled directly to the diaphragm support and causes the outer edge of the diaphragm to oscillate transversely, thereby giving rise to undulations in the diaphragm perpendicularly to its plane, which undulations have the effect of propelling the fluid from the inlet towards the outlet of the pump.

Advantageously, the actuator(s) is/are selected to be of the movable magnet type or indeed of the reluctance type. Nevertheless, the masses set into motion by an actuator of that type are relatively large since they comprise, for example: the magnets, the magnet supports, the parts connecting to the diaphragm support, and the suspension springs. In such a pump, the mass of the movable portions of the actuator not only affects coupling between the undulating diaphragm and the fluid, the effectiveness of diaphragm motion, and the efficiency of the pump head, but also limits the potential operating frequency of the actuator, and leads to noise and vibration that can be troublesome.

Associating a suspension spring for the movable mass does not solve those operating problems.

OBJECT OF THE INVENTION

An object of the invention is to provide an undulating diaphragm pump of improved efficiency, and that does not present the above-mentioned drawbacks.

BRIEF DESCRIPTION OF THE INVENTION

In order to achieve this object, there is provided a pump having an undulating diaphragm mounted on a support for undulating between two end plates under drive from at least one electromagnetic actuator in order to transfer a fluid between an inlet of the pump and an outlet of the pump. According to the invention, the pump includes adapter means connecting the diaphragm support to a movable portion of the actuator in order to shorten the stroke of the movable mass of the actuator such that its stroke is shorter than the stroke of the diaphragm support.

Such a reduction in the stroke of the movable portion of the actuator serves to improve coupling between the undulating diaphragm and the fluid, to improve the effectiveness of diaphragm motion by optimizing its reaction force, and thus to improve propulsion efficiency. In the actuator, it enables the operating frequency to be increased, and reduces the mechanical losses associated with friction and viscous losses. And naturally, reducing the stroke contributes to diminishing the vibration generated by the actuator and to which the pump is subjected. This reduction also makes it possible to increase the force/mass ratio, thereby making it possible to reduce kinetic losses associated with the movement of the masses, and thus to increase the overall efficiency of the pump. These improvements lead to better efficiency for the pump head and to an actuator that is more compact.

In a particular embodiment of the invention, the adapter means comprise at least one lever having one end hinged to the diaphragm support and its other end hinged to a stationary point, the movable portion of the actuator being coupled to the lever so that its stroke is shorter than the stroke of the diaphragm support.

BRIEF DESCRIPTION OF THE FIGURES

The invention can be better understood in the light of the figures of the accompanying drawings, in which:

FIG. 2Bis is a section view of a second embodiment of a pump implementing the second principle of the invention;

FIG. 3 is a diagrammatic section view of a pump implementing a third principle of the invention.

DETAILED DESCRIPTION OF THE INVENTION

Figure 1:
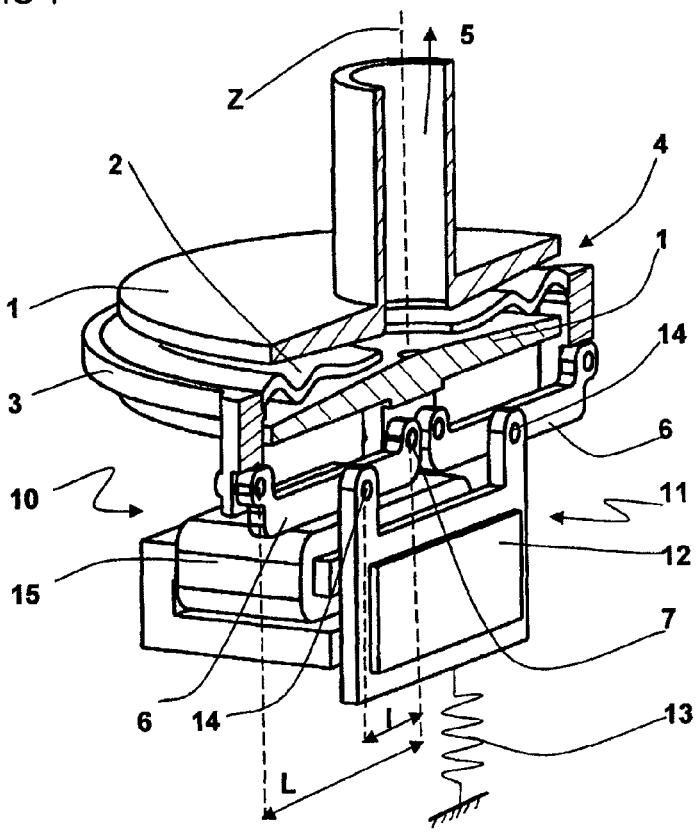
FIG. 1 is a diagrammatic section view of an embodiment of a pump implementing a first principle of the invention.

With reference to FIG. 1, and according to a first implementation principle of the invention, the pump shown comprises two generally disk-shaped end plates 1 having a likewise disk-shaped undulating diaphragm 2 extending between them. The diaphragm is fastened by its outer edge to a rigid diaphragm support 3 to which oscillations are imparted to cause the diaphragm 2 to undulate and to force the liquid to flow from an inlet 4 of the pump towards an outlet 5. The oscillations of the support 3 of the diaphragm 2 are generated by an electromechanical actuator 10 as described below.

The pump includes adapter means, specifically two levers 6 in this example, each of which is hinged firstly to a stationary point 7 and secondly to the diaphragm support 3. The actuator 10 has two movable portions 11, each modeled in this example by a movable mass 12 associated with a spring 13 coupled to a stationary point, and by way of example to a part that is secured to the end plates. The spring 13 is of stiffness such that the assembly formed by the movable mass and the spring has a resonant frequency close to an operating frequency of the pump. In this example the movable mass 12 is coupled to the lever 6 at a point 14 situated between the two ends of the lever 6. Electromagnetic excitation of the movable mass 12 by an associated stationary coil 15 causes the movable mass 12 to oscillate along a direction Z perpendicular to the mean plane of the diaphragm 2, thereby causing the diaphragm support 3 to oscillate, and thus giving rise to undulations in the diaphragm 2 between the end plates 1, which undulations result from propagation of a traveling wave for which the diaphragm constitutes the medium. The movable mass 12 in this example carries permanent magnets.

In FIG. 1, L is the length of the lever (measured parallel to the mean plane of the diaphragm) and d is the distance measured parallel to L between the stationary end of the lever 6 and the point where the lever is coupled to the movable mass 12 of the actuator 10. In this example, it can be seen that the distance d is less than the distance L, and thus that the stroke of the actuator 10 is thus smaller than the movement of the diaphragm support 3 since the stroke is proportional to said movement by the ratio d/L. In addition, the pump behaves as though the inertial mass M of the diaphragm support were increased by a quantity $d \cdot m/L$ where m is the mass of the movable mass 12. The added inertial mass is thus smaller than the added inertial mass in a prior art pump in which the actuator is coupled directly to the diaphragm support, which mass would be equal to m. These provisions contribute to improving the effectiveness of the diaphragm, to making an increase in the operating frequency possible, and to decreasing the vibration of the pump.

Figure 2:
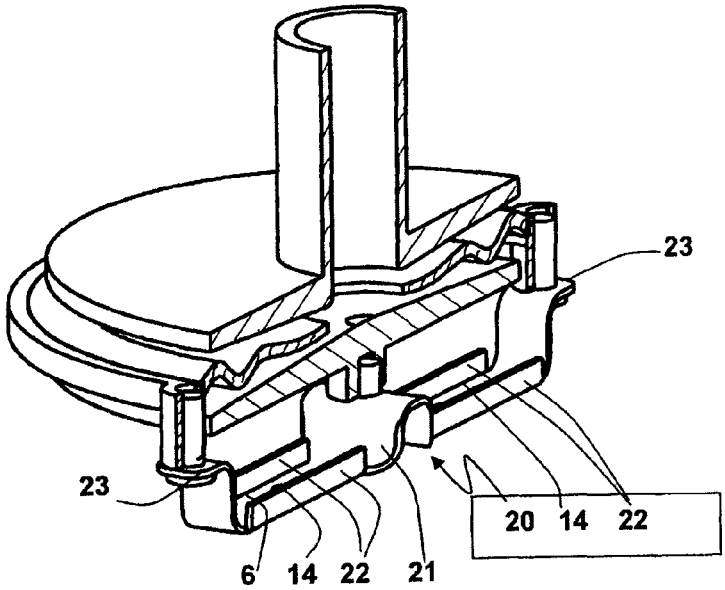
FIG. 2 is a section view of a first embodiment of a pump implementing a second principle of the invention.

With the principle of the invention explained above, FIG. 2 shows an example of a practical implementation of this principle. In this example the diaphragm support 3 is actuated at two diametrically opposite points. The two levers 6' are constituted in this example by a single metal sheet 20 that is cut and folded to shape.

More precisely, the metal sheet 20 has a central portion 21 that is formed into a flexible U-shape that constitutes a return spring and that is fastened to the body of the pump. The metal sheet 20 is extended by two lever-forming arms 6' having edges 22 that are folded to give greater bending stiffness to the arms. The arms are terminated by connection portions 23 for connecting to the diaphragm support. Each of the arms is engaged at a point 14, substantially in the middle thereof, by an actuator. Thus, a single part constitutes both the lever and the return spring. The stiffness of this spring portion may be set to a value such that when associated with the mass of the movable mass, the resonant frequency of the oscillator is close to the operating frequency desired for the pump.

Numerous variants may be implemented in the context of the invention using one or more optionally-coupled levers that are optionally associated with return springs, with it being possible for the actuators to engage the levers from the other side of the point where the levers are hinged to the pump body.

In the embodiment of the invention shown in FIG. 2Bis, the lever-forming arms 6' carry permanent magnets 45 that are subjected to the action of the coil 15, such that the arms weighted by the magnets themselves form the movable masses of the actuator excited by the coil. The magnets 45 are carried by the arms at a distance from the diaphragm support, preferably between the lever hinge point and the point where the lever is coupled to the diaphragm support, such that the stroke of the movable portion is indeed smaller than the movement of the diaphragm support. This provision makes the assembly particularly simple and compact.

According to another implementation principle of the invention, as shown in FIG. 3, the adapter means comprise a connection or suspension spring 25 interposed between the diaphragm support 3 and the movable mass 12 of the actuator 10. The suspension 25 serves to reduce the stroke of the movable mass 12 of the actuator, for a given stroke of the diaphragm support 3. This provision leads to an actuator in which the movable masses 12 oscillate with smaller amplitude, at least for a given excitation frequency range, such that vibration is decreased. The spring 13 in this example is constituted by a bent elastically-deformable blade.

Figure 4:
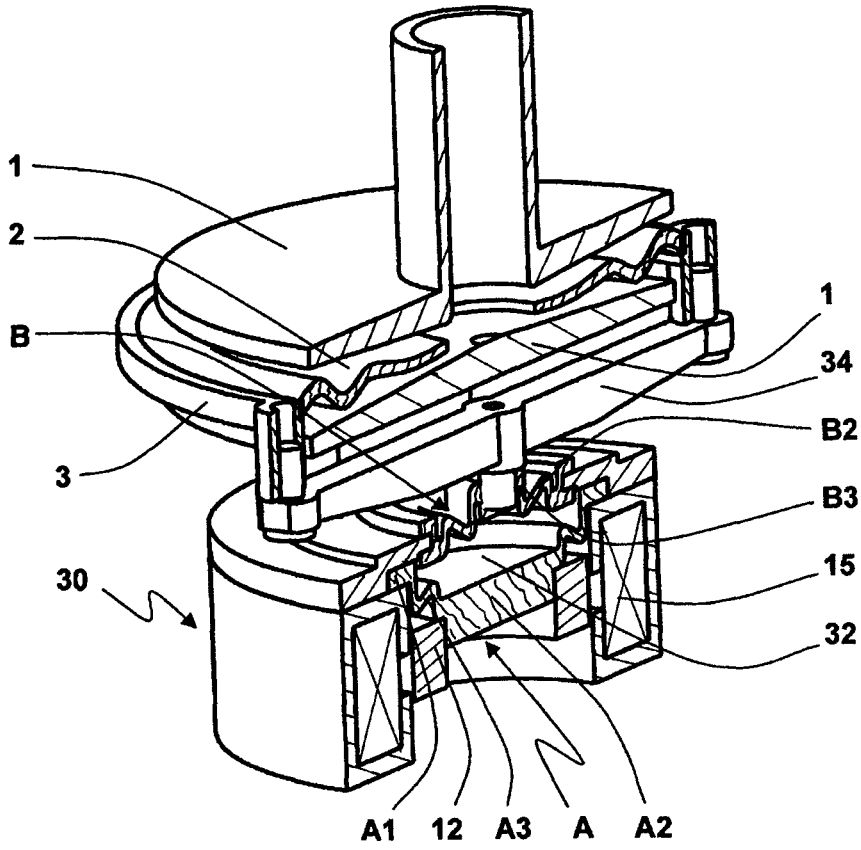
FIG. 4 is a diagrammatic section view of a pump implementing a fourth principle of the invention.

In another embodiment of the invention, as shown in FIG. 4, the pump includes adapter means consisting in a pneumatic or hydraulic stroke actuator 30. In this example the movable mass 12 is of annular shape and slides back and forth under electromagnetic drive from the stationary coil 15. The stroke actuator 30 comprises a diaphragm A and a diaphragm B that define a sealed chamber 32 that is filled with gas or with liquid, as appropriate. The diaphragm A is coupled to the movable mass 12, while the diaphragm B is coupled to the diaphragm support 3 via an arm 34.

The diaphragm A has a pinched edge A1 and possesses a rigid bottom A2 forming a piston that is coupled to the movable mass 12 and that is connected to the edge A1 by a bellows A3. The diaphragm B has an edge B1 that is stationary, being fastened to a central sleeve B3 that is coupled to the arm 34, and that is connected to the edge B1 by a bellow B2.

The area of the diaphragm A is greater than the area of the diaphragm B. Thus, when the movable mass 12 moves over a given stroke, it imparts movement to the sleeve B3 of the diaphragm B that is greater than the stroke of the movable mass 12. As a result the movable mass 12 moves over a shorter distance than the diaphragm support 3.

The invention is not limited to the above description, but on the contrary covers any variant coming within the ambit defined by the claims. In particular, although the invention is illustrated herein in application to disk-shaped undulating diaphragm pumps, it is clear that the invention applies to undulating diaphragm pumps that are annular or rectilinear in shape.

The invention applies to any type of actuator and in particular to actuators that are linear or rotary, or that implement angular movement, . . . .

What is claimed is:

1. A pump, comprising:

an undulating diaphragm;

a diaphragm support;

two end plates, said undulating diaphragm being mounted on said diaphragm support such that the diaphragm undulates between said two end plates under drive from at least one electromagnetic actuator in order to transfer a fluid between an inlet of the pump and an outlet of the pump; and adapter means connecting the diaphragm support to a movable mass of a movable portion of the actuator, said adapter means being adapted to shorten the stroke of the movable mass of the actuator when said movable mass is oscillating and such that the stroke of the movable mass is shorter than the stroke of the diaphragm support and said adapter means comprise a first lever and a second lever each hinged firstly to the diaphragm support and secondly to a respective stationary point, wherein the movable mass of the movable portion of the actuator is coupled to a point of the first lever and to a point of the second lever.

2. A pump having an undulating diaphragm mounted on a support for undulating between two end plates under drive from at least one electromagnetic actuator in order to transfer a fluid between an inlet of the pump and an outlet of the pump, wherein the pump includes adapter means connecting the diaphragm support to a movable mass of a movable portion of the actuator in order to shorten the stroke of the movable mass of the actuator such that its stroke is shorter than the stroke of the diaphragm support, wherein the adapter means comprise first and second levers hinged firstly to the diaphragm support and secondly to a stationary point, the movable portion of the actuator being coupled to a point of each lever, wherein the two levers are made in a portion of sheet metal that is cut and shaped to present a central bridge forming a spring suspending the movable portion of the actuator and from which the two levers extend.

3. The pump according to claim 2, wherein the spring presents stiffness that is set in such a manner that in association with the movable mass the assembly formed by the movable mass and the spring has a resonant frequency close to an operating frequency of the pump.

4. A pump having an undulating diaphragm mounted on a support for undulating between two end plates under drive from at least one electromagnetic actuator in order to transfer a fluid between an inlet of the pump and an outlet of the pump, wherein the pump includes adapter means connecting the diaphragm support to a movable mass of a movable portion of the actuator in order to shorten the stroke of the movable mass of the actuator such that its stroke is shorter than the stroke of the diaphragm support, wherein the adapter means comprise first and second levers hinged firstly to the diaphragm support and secondly to a stationary point, the movable portion of the actuator being coupled to a point of the lever, wherein the two levers form a support for the movable mass of the actuator.

5. A pump having an undulating diaphragm mounted on a support for undulating between two end plates under drive from at least one electromagnetic actuator in order to transfer a fluid between an inlet of the pump and an outlet of the pump, wherein the pump includes adapter means connecting the diaphragm support to a movable mass of a movable portion of the actuator in order to shorten the stroke of the movable mass of the actuator such that its stroke is shorter than the stroke of the diaphragm support, wherein the adapter means comprise a pneumatic or hydraulic stroke adapter for coupling an arm connected to the diaphragm support to the movable portion of the actuator in such a manner that the movable portion of the actuator presents a stroke that is shorter than the stroke of the arm.

* * * * *